US011021845B1

(12) United States Patent
Hargrave

(10) Patent No.: US 11,021,845 B1
(45) Date of Patent: Jun. 1, 2021

(54) SHEET PILING FILLER-CORNER

(71) Applicant: CMI LIMITED CO., Marietta, GA (US)

(72) Inventor: Steven E. Hargrave, Roswell, GA (US)

(73) Assignee: CMI LIMITED CO., Marietta, GA (US)

( * ) Notice: Subject to any disclaimer, the term of this patent is extended or adjusted under 35 U.S.C. 154(b) by 0 days.

(21) Appl. No.: 16/700,117

(22) Filed: Dec. 2, 2019

(51) Int. Cl.

| | |
|---|---|
| ***E02D 5/02*** | (2006.01) |
| ***E02D 5/10*** | (2006.01) |
| ***E02D 5/04*** | (2006.01) |
| ***E02D 5/08*** | (2006.01) |
| ***E02D 5/14*** | (2006.01) |
| *E02D 5/16* | (2006.01) |

(52) U.S. Cl.
CPC . *E02D 5/08* (2013.01); *E02D 5/16* (2013.01)

(58) Field of Classification Search
CPC .... E02D 5/08; E02D 5/16; E02D 5/02; E02D 5/10; E02D 5/04; E02D 5/14
USPC ..... 405/274–281
See application file for complete search history.

(56) References Cited

U.S. PATENT DOCUMENTS 2,054,203 A * 9/1936 Magee ..... E02D 5/08 405/276
2,063,293 A * 12/1936 Borberg ..... E02D 5/08 405/281
4,099,387 A * 7/1978 Frederick ..... E02D 5/04 173/197
4,162,866 A * 7/1979 Kita ..... E02D 17/04 405/277
4,674,921 A 6/1987 Berger
5,106,233 A * 4/1992 Breaux ..... B09B 1/008 405/129.8
6,092,346 A * 7/2000 Even ..... E02D 5/06 52/579
6,575,667 B1 6/2003 Burt et al.
7,025,539 B2 4/2006 Irvine
D649,443 S * 11/2011 Heindl ..... D8/382
D681,431 S * 5/2013 Heindl ..... D8/382
D681,432 S * 5/2013 Heindl ..... D8/382
D681,433 S * 5/2013 Heindl ..... D8/382
D794,436 S * 8/2017 Heindl ..... D8/382
D832,690 S * 11/2018 Heindl ..... D8/382
(Continued)

FOREIGN PATENT DOCUMENTS

JP H05272131 A * 10/1993

OTHER PUBLICATIONS

CMI 225/425C Corner; Commercially sold prior to Jan. 1, 2000; 2 pgs.

*Primary Examiner* — Edwin J Toledo-Duran
(74) *Attorney, Agent, or Firm* — Gardner Groff & Greenwald, PC

(57) ABSTRACT

A sheet piling filler-corner member includes one or more female couplings for engagement of male couplings of connected sheet pilings, and one or more male coupling members for engagement within female couplings of connected sheet pilings. Selective attachment of sheet pilings using the filler-corner member, and/or modification of the filler-corner member into different configurations allows the filler-corner member to universally function as a spacer or filler for adding length to a sheet piling assembly, as a corner coupling, or as a gender-change adapter between sheet pilings.

21 Claims, 13 Drawing Sheets

(56) References Cited

U.S. PATENT DOCUMENTS 10,119,234 B1 * 11/2018 Yeany ..... E02D 29/02
10,626,571 B2 * 4/2020 Pietrucha ..... E02B 3/108
D885,609 S * 5/2020 Seiler ..... D25/121
D893,988 S * 8/2020 Heindl ..... D8/382
2002/0102131 A1 * 8/2002 Wall ..... E02D 5/08
403/363
2004/0013474 A1 * 1/2004 Weyant ..... E02D 5/16
405/276
2005/0042038 A1 * 2/2005 Irvine ..... E02D 5/03
405/276
2005/0053429 A1 * 3/2005 Davidsaver ..... E02D 5/03
405/284
2005/0076595 A1 * 4/2005 Wall ..... E02D 5/08
52/506.01
2005/0226690 A1 * 10/2005 MacDonald ..... E02D 5/08
405/274
2005/0254905 A1 * 11/2005 Nishiyama ..... E02D 5/06
405/274
2006/0179771 A1 * 8/2006 Heindl ..... E02D 5/04
52/588.1
2006/0283139 A1 * 12/2006 Wall ..... E02D 5/04
52/782.1
2007/0217870 A1 * 9/2007 Davidsaver ..... E02B 3/06
405/284
2008/0145154 A1 * 6/2008 Heindl ..... E02D 5/08
405/279
2008/0310924 A1 * 12/2008 Heindl ..... E02D 5/08
405/279
2015/0010366 A1 * 1/2015 McShane ..... E02D 5/02
405/279
2016/0115666 A1 * 4/2016 Hargrave ..... F16J 15/027
405/274
2018/0155890 A1 * 6/2018 Pietrucha ..... B32B 17/04
2018/0305883 A1 * 10/2018 Jarvie ..... E02D 17/18
2019/0127941 A1 * 5/2019 Sydlik ..... E02D 5/04
2020/0002911 A1 * 1/2020 Pedrocco ..... E02D 7/24
2020/0149240 A1 * 5/2020 Jarvie ..... E02D 13/00
2020/0173131 A1 * 6/2020 Heindl ..... E02D 5/08

* cited by examiner

SHEET PILING FILLER-CORNER

TECHNICAL FIELD

The present invention relates generally to the field of sheet piling or sheet pile barrier or wall structures, and more particularly to a combination sheet piling filler-corner member.

BACKGROUND

Sheet piling (or sheet piles) are elongate panels or extrusions used to form barrier or wall structures. Typically, sheet pilings include a slotted female coupling channel at one end and a male flange at the other end, so that multiple sheet pilings can be coupled together side-by-side in an array or assembly to form a barrier or wall of any desired span or length. Sheet pilings may be driven to a desired depth into the ground, for example using a crane and mandrel with a vibratory or impact driver, to anchor an above-ground structure such as a seawall or bulkhead, or to form a below-ground barrier wall. The interlocking between male and female coupling elements of adjacent sheet pilings creates an integrated structure lending strength to the assembly and in some instances to form a barrier or seal against the passage of water. Sheet pilings may be constructed of steel, polyvinyl chloride (PVC) or other materials. Various sheet piling configurations are known, as shown for example by U.S. Pat. No. 4,674,921 (corrugated), U.S. Pat. No. 6,575,667 (C-channel or box), and U.S. Pat. No. 7,025,539 (flat panel), all of which patents are incorporated by reference herein.

Sheet pilings are typically provided in standard widths, for example 12"-48". In some instances, however, a desired span is not an even multiple of the standard sheet piling width, which complicates construction and may compromise the integrity of the barrier. In some instances, it may be possible to apply sufficient force to expand or contract the width of a Z-shaped or C-shaped sheet piling to fit an uneven span within a wall, but doing so may risk cracking the piling. And for flat panel pilings, this method is typically not an option. In other instances, confronting locks of two adjacent sheet piling panels may be cut off and the panels bolted to one another to form a non-standard width assembly, but doing so can interfere with the use of installation equipment and also may allow water migration through the bolted joint.

It may also be necessary to change the gender of sheet piling locks (i.e., male-to-female or female-to-male locks) at one or more locations along the span of a wall, for example where two spans coming from different directions intersect, or at corners. Typically, this necessitates cutting panels in the field and bolting or otherwise connecting segments of sheet pilings together, potentially weakening the structure and allowing water migration. Also, when forming corners along a span of sheet pilings, the legs or flanges of some sheet piling configurations may interfere with each other, and the interengaging lock or coupling elements of typical sheet pilings do not permit formation of sharp corners. Cutting off interfering flanges may weaken the overall structure, and attempts to form sharp corners may result in decoupling or unzipping of the locks between adjacent sheet pilings.

Accordingly, it can be seen that needs exist for improved devices and methods for constructing sheet piling walls and structures. It is to the provision of devices and methods meeting these and other needs that the present invention is primarily directed.

SUMMARY

In example embodiments, the present invention provides a sheet piling filler-corner member that allows construction of walls or other structures having a span that is not an even multiple of a standard sheet piling width dimension (i.e., a filler section that is shorter than a full-width sheet piling). Example embodiments also enable a gender change of sheet piling locks along the span of a wall (i.e., male-to-female or female-to-male lock switching). Example embodiments also provide for construction of sharp corners in a sheet piling wall or other structure, while avoiding interference between flanges or legs of adjacent pilings and maintaining coupling integrity of the locks of the sheet pilings.

In one aspect, the present invention relates to a sheet piling filler-corner member. The sheet piling filler-corner member preferably includes a main body panel having a first side and a second side and defines a width-wise dimension extending between the first and second sides. The sheet piling filler-corner member preferably also includes a first female lock coupling at the first side of the main body panel configured to receive a male sheet piling coupling member, and a male lock member at the second side of the main body panel configured for engagement within a female sheet piling coupling. The sheet piling filler-corner member preferably also includes a second female lock coupling offset from the first female lock coupling.

In another aspect, the invention relates to a sheet piling filler-corner member. The sheet piling filler-corner member preferably includes a main body panel, a first female lock coupling configured to receive a male sheet piling coupling member of a first sheet piling, and a first male lock coupling and a second male lock coupling. Each of the first and second male lock couplings are preferably configured for engagement within a female sheet piling coupling of a second sheet piling, wherein the second male lock coupling is planarly aligned with the first female lock coupling for use in a filler configuration, and wherein the first male lock coupling is angularly offset from the first female lock coupling for use in a first corner configuration.

In still another aspect, the invention relates to a sheet piling filler-corner member. The sheet piling filler-corner member preferably includes at least two female lock couplings, each of the female lock couplings being configured to receive a male sheet piling coupling member. The sheet piling filler-corner member preferably also includes at least two male lock couplings, each of the male lock couplings being configured for engagement within a female sheet piling coupling. The sheet piling filler-corner member is preferably configured for use in a filler configuration between first and second sheet pilings aligned in a generally linear assembly, and for use in a corner configuration between first and second sheet pilings aligned in an angularly offset assembly.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
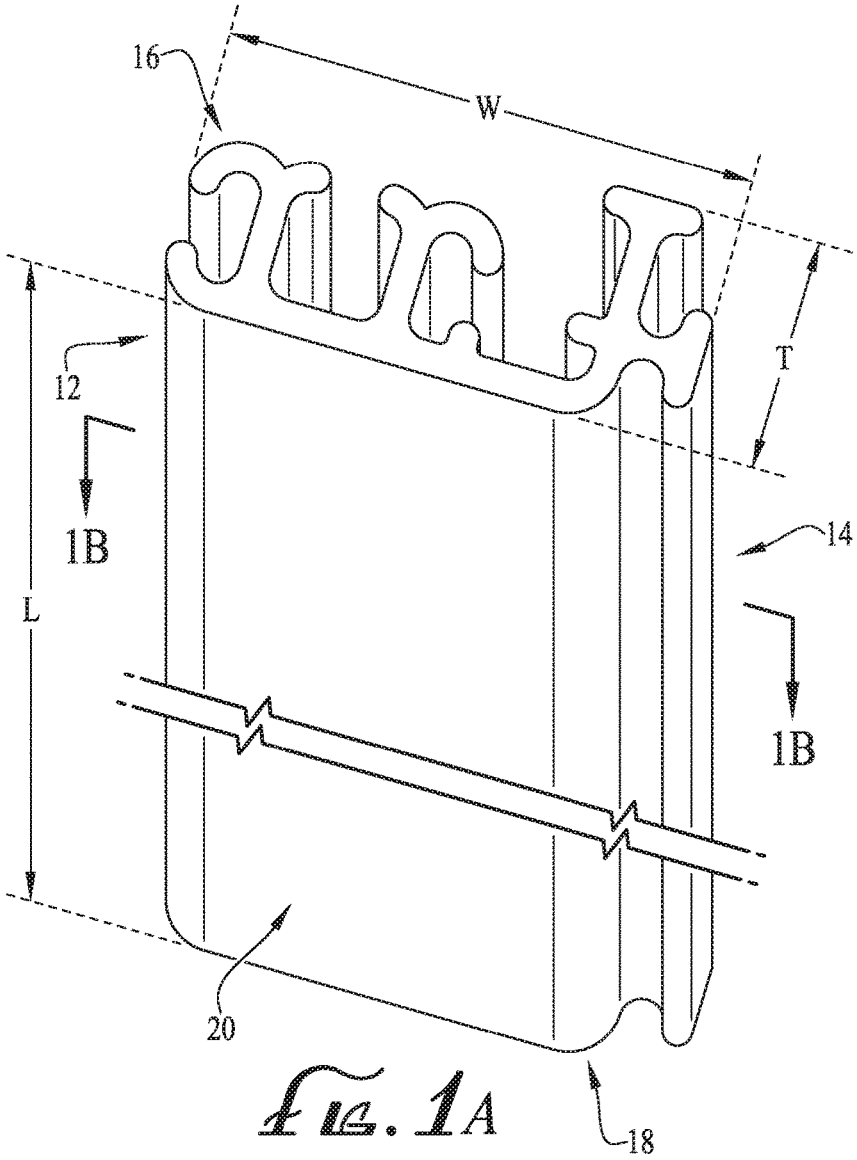
FIG. 1A is a perspective view of a sheet piling filler-corner member according to an example embodiment of the present invention.
Figure 1B:
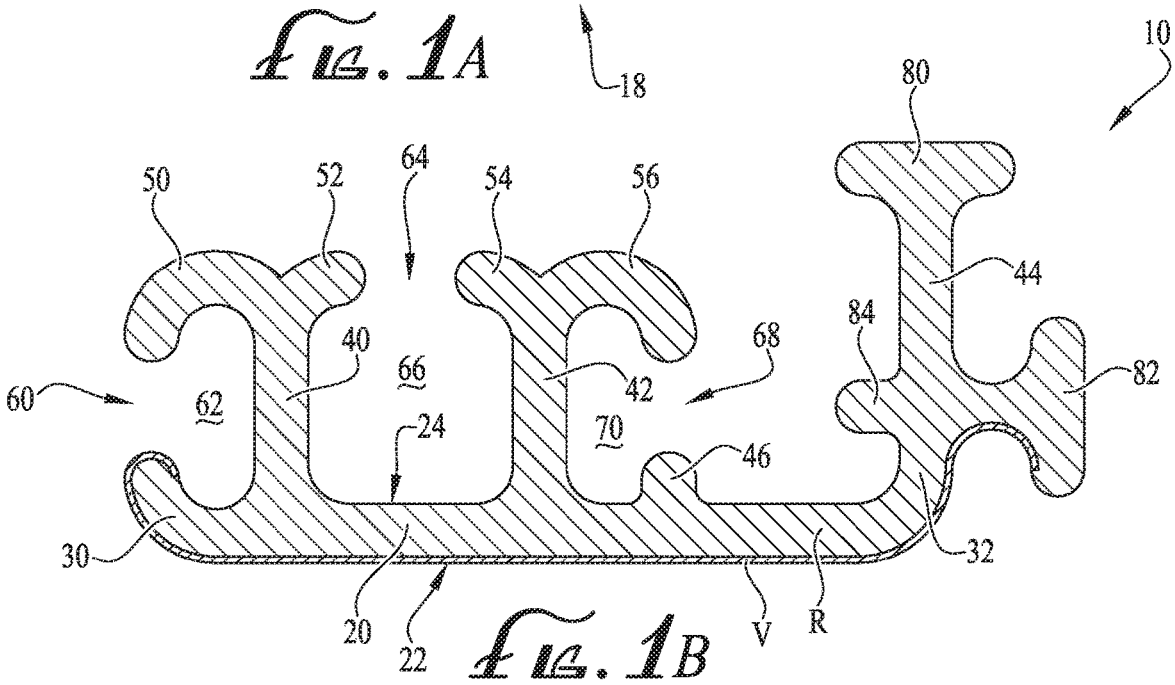
FIG. 1B is a cross-sectional view of the sheet piling filler-corner member of FIG. 1.

With reference now to the drawing figures, wherein like reference numbers represent corresponding parts throughout the several views, FIGS. 1A and 1B show a sheet piling filler-corner member 10 according to an example embodiment of the present invention. The filler-corner member 10 comprises an elongate body defining a length L, a width W, and a thickness T. In example embodiments, the filler-corner member 10 is formed by extrusion, and may be cut to various specified nominal lengths L, for example corresponding to the length of sheet pilings the filler-corner member is to be used in connection with, such as 6', 8', 10', 12', 16', or to be field cut to a desired length. Alternatively, the filler-corner member can be formed by molding or other fabrication processes. The filler-corner member 10 is preferably integrally formed as a single unitary or monolithic piece, but alternatively can be formed as an assembly of multiple pieces attached together, for example by adhesive, solvent bonding or welding. In example embodiments, the filler-corner member 10 is formed from polyvinyl chloride (PVC), fiber reinforced polymer, acrylic, vinyl, acrylonitrile styrene acrylate (ASA), polyolefin, steel, aluminum, or other metals, plastics, polymers, composites or other materials of construction. In example embodiments, the filler-corner member 10 may be fabricated at least partially from recycled content, for example recycled PVC. For example, in the example embodiment depicted in FIG. 1B, an outer or exterior front section or cladding of virgin content PVC or other virgin material V is coextruded or otherwise formed in combination with or applied to a base or core of recycled material R forming the remainder of the filler-corner member 10. In alternate embodiments, the filler-corner member 10 may be formed primarily from recycled content, or at least having a majority content of recycled material, entirely from recycled material; or can be formed from a majority content or entirely of virgin material.

In example embodiments, the width W of the filler-corner member 10 is an even divisor or factor of a standard width of a sheet piling the filler-corner member is to be used in connection with. For example, a 4" wide filler-corner member 10 is an even divisor or factor of a 12" wide sheet piling (3×4=12) and of a 24" wide sheet piling (6×4=24). In further examples, the width W may be 1", 2", 3", 6", or other greater or lesser values, optionally in even increments of imperial (inches) or metric (centimeters) units of length. Similarly, the thickness T may be 1", 2", 3", 6", or other greater or lesser values, optionally in even increments of imperial (inches) or metric (centimeters) units of length. In example embodiments, the width W is greater than the thickness T, optionally an even multiple thereof.

The filler-corner member 10 comprises a main body panel 20 extending generally planarly in a widthwise direction between a first side 12 and a second side 14, in a lengthwise direction along the length of the filler-corner member 10 between a first end 16 and a second end 18, and having a front or proximal face 22 and a back or distal face 24. The first side of the main body panel 20 transitions to an arcuate or curved first side flange 30, which curves smoothly in a distal direction (i.e., from the front face 22 toward the back face 24) at the first side of the filler-corner member 10. The second side of the main body panel 20 transitions to an arcuate or curved second side flange 32, which curves smoothly in the distal direction, at a position toward the opposite second side of the filler-corner member 10.

A first transverse flange 40 extends distally and generally perpendicularly from the back face 24 of the main body panel 20 adjacent the first side of the main body panel 20. A second or intermediate transverse flange 42 extends distally and generally perpendicularly from the back face 24 of the main body panel 20 at a medial portion of the main body panel 20. And a third transverse flange 44 extends distally from the second side flange 32 at the second side of the main body panel 20, generally perpendicular to the main body panel. The third transverse flange 44 is generally aligned with and extends substantially continuously from the second side flange 32. A short transverse rib 46 extends distally and generally perpendicularly from the back face 24 of the main body panel 20 at a medial portion of the main body panel 20 between the second transverse flange 42 and the third transverse flange 44. The first transverse flange 40, intermediate transverse flange 42, third transverse flange 44, and the transverse rib 46 are generally aligned parallel to one another (i.e., extending along generally parallel planes) in a widthwise spaced apart arrangement. The first transverse flange 40, intermediate transverse flange 42, third transverse flange 44, and the transverse rib 46 extend lengthwise along substantially the entire length of the filler-corner member 10. The first transverse flange 40 and the intermediate transverse flange 42 are of substantially equal length in the thickness-wise dimension, whereas the third transverse flange 44 is longer and the transverse rib 46 is shorter than the first and intermediate transverse flanges in the thickness-wise dimension.

The first transverse flange 40 is attached at its proximal end to the back face 24 of the main body panel 20, and at its opposite free end transitions to a first distal flange 50 and a second distal flange 52. The first distal flange 50 comprises an arcuate body that curves smoothly toward the first side 12 of the filler-corner member 10 and in a proximal direction (i.e., toward the front face 20). The second distal flange 52 comprises an arcuate body that curves smoothly toward the second side 14 of the filler-corner member 10. The second or intermediate transverse flange 42 is attached at its proximal end to the back face 24 of the main body panel 20, and at its opposite free end transitions to a third distal flange 54 and a fourth distal flange 56. The third distal flange 54 comprises an arcuate body that curves smoothly toward the first side 12 of the filler-corner member 10. The fourth distal flange 56 comprises an arcuate body that curves smoothly toward the second side 14 of the filler-corner member 10 and in a proximal direction. In alternate embodiments, one or more of the first side flange 30 and the distal flanges 50, 52, 54, 56 may comprise straight or angled flanges rather than arcuately curved flanges.

Figure 1C:
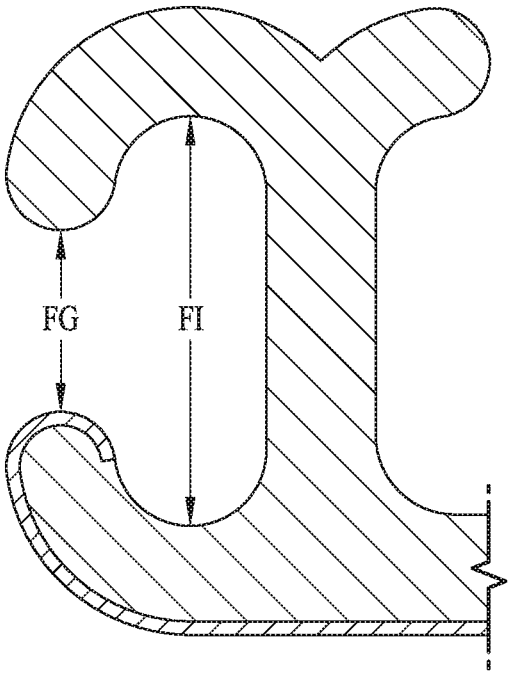
FIGS. 1C and 1D are close-up views of the female and male lock profiles, respectively, of the sheet piling filler-corner member of FIG. 1.

The first side flange 30 and the first distal flange 50 curve toward one another, each spanning about 180° of curvature between their free ends and their transition from the first transverse flange 40, so that their free ends define a first slot 60 therebetween, which opens into an internal concavity or chamber that forms a first female receiver or lock coupling 62, which faces toward the first side 12 of the filler-corner member 10. The second distal flange 52 and the third distal flange 54 curve toward one another, each spanning about 90° of curvature between their free ends and their transitions from the first and second transverse flanges 40, 42, respectively, so that their free ends define a second slot 64 therebetween, which opens into an internal concavity or chamber that forms a second female receiver or lock coupling 66, which faces the distal direction opposite the front face 22 of the filler-corner member 10. The fourth distal flange 56 curves toward the transverse rib 46, spanning about 180° of curvature between its free end and its transition from the second transverse flange 42, so that the free end of the fourth distal flange and the transverse rib define a third slot 68 therebetween, which opens into an internal concavity or chamber that forms a third female receiver or lock coupling 70, which faces toward the second side 14 of the filler-corner member 10. In this manner, the first female lock coupling 62 is oriented generally opposite (i.e., 180° from) and co-planarly aligned with the third female lock coupling 70, and the second female lock coupling 66 is oriented generally perpendicular to (i.e., 90° from) the first and third female lock couplings 62, 70. The first, second and third slots 60, 64, 68, and the first, second and third female lock couplings 62, 66, 70 preferably have dimensions corresponding to standard sheet piling female lock couplings of sheet pilings with which the filler-corner member 10 is intended to be used. For example, as shown in FIG. 1C, the slots 60, 64, 68 of the female lock couplings 62, 66, 70 may have a female lip gap dimension FG of between 0.300" to 0.900", and the female inside opening FI may have a dimension of between 0.800" to 1.800".

Figure 1D:
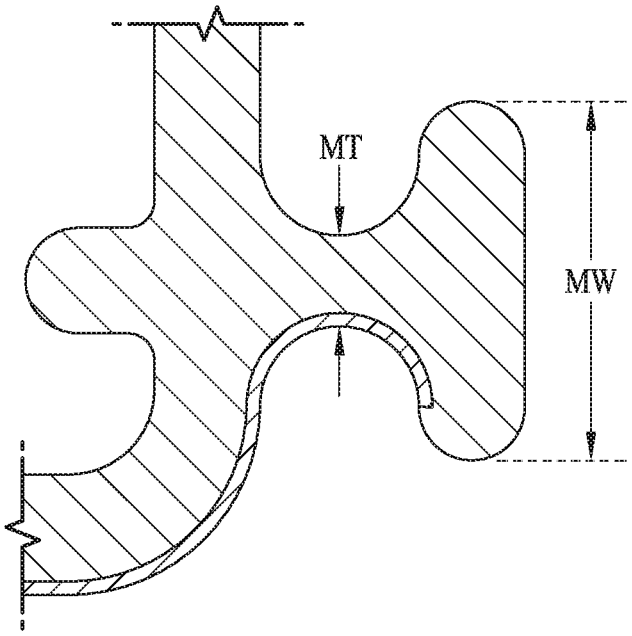

The third transverse flange 44 extends distally from its transition or connection with the second side flange 32 to a free end forming a first male coupling flange or lock member 80. A second male coupling flange or lock member 82 extends laterally from the third transverse flange 44, at or around its transition or connection with the second side flange 32, in the direction of the second side 14 of the filler-corner member 10. A short lateral rib 84 extends laterally from the third transverse flange 44, generally opposite the second male lock member 82, in the direction of the first side 12 of the filler-corner member 10. In this manner, the first male lock member 80 is oriented facing generally perpendicular to the main body panel 20 of the filler-corner member 10, and faces 90° (i.e., planarly transverse) from the first female lock coupling 62; and the second male lock member 82 is generally planarly aligned with and oriented facing opposite or away from (180° from) the first female lock coupling. As noted above, the widthwise spacing between the first female lock coupling 62 at the first side 12 of the filler-corner member 10 and the second male lock member 82 at the second side 14 of the filler-corner member is optionally an even divisor or factor of a standard sheet piling width. The first male lock member 80 and the second male lock member 82 preferably have dimensions corresponding to standard sheet piling male lock members of sheet pilings with which the filler-corner member 10 is intended to be used. For example, as shown in FIG. 1D, the male lock members 80, 82 may have a male flange width MW of between 0.600" to 1.600", and a male connecting web or I-beam thickness MT of between 0.170" to 0.550". Also, when the filler-corner member 10 is modified as described below by cutting to form a female-to-female coupling adapter with male-male ends, the lateral rib 84 and connecting web of the second male lock member 82 form a third male lock member also preferably having standard sheet piling male lock member dimensions.

The filler-corner member 10 may be used and modified according to a number of methods and modes of use, to provide a universal part for different uses, applications, sheet piling formats, and structure designs, including without limitation: (1) extending (or filling) the span of a barrier wall or other structure constructed from sheet pilings; (2) forming a corner coupling between sheet pilings within a structure; and/or (3) providing an adaptor or gender-change coupling for attachment of otherwise incompatible lock elements of adjacent sheet pilings within a structure. Example methods of use, applications, and structures are shown in FIGS. 2-14.

Figure 2:
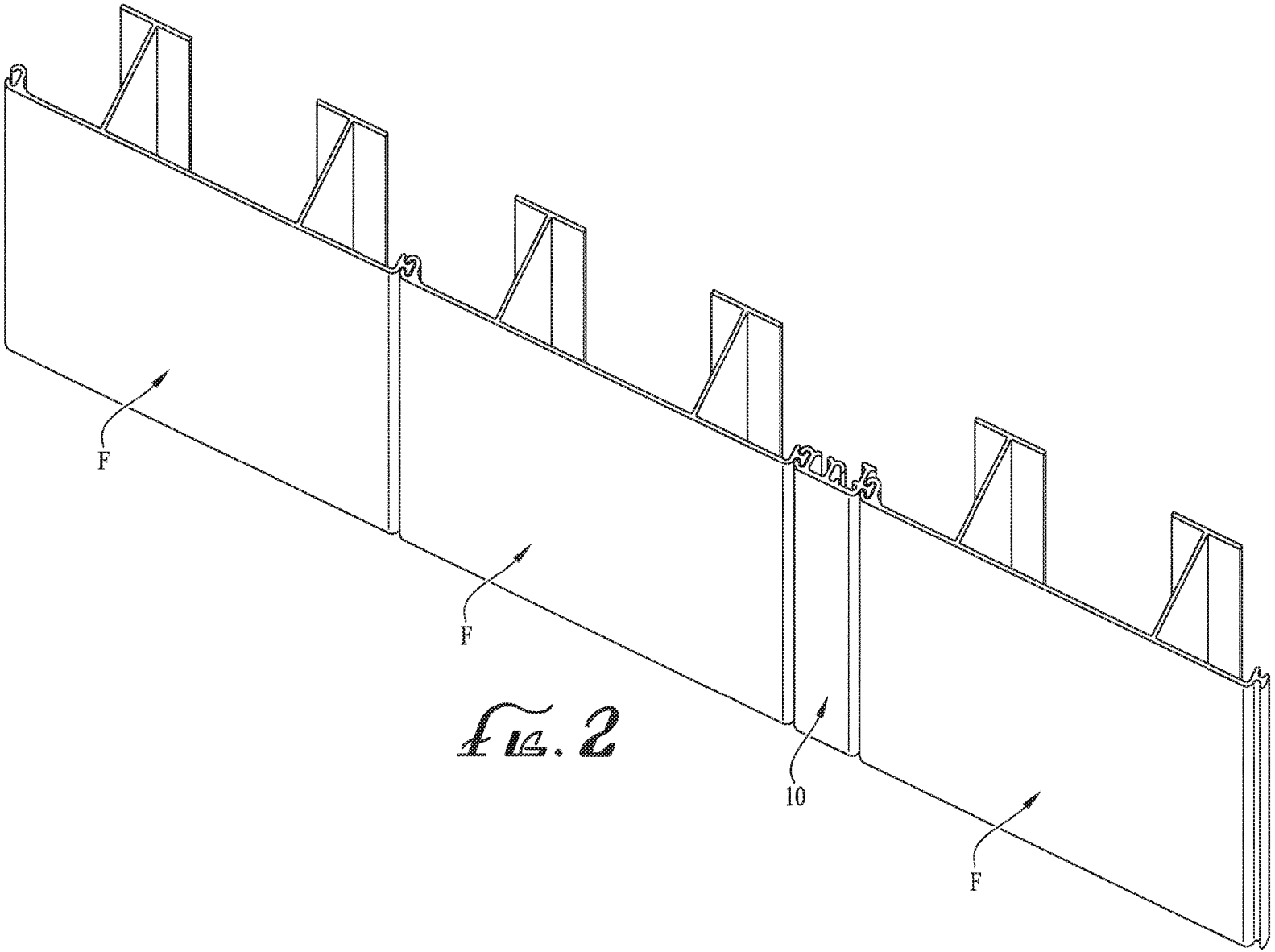
FIG. 2 shows a sheet piling filler-corner member according to FIG. 1 used in combination with flat panel sheet pilings to form a section of a barrier wall structure according to an example embodiment of the present invention.
Figure 3:
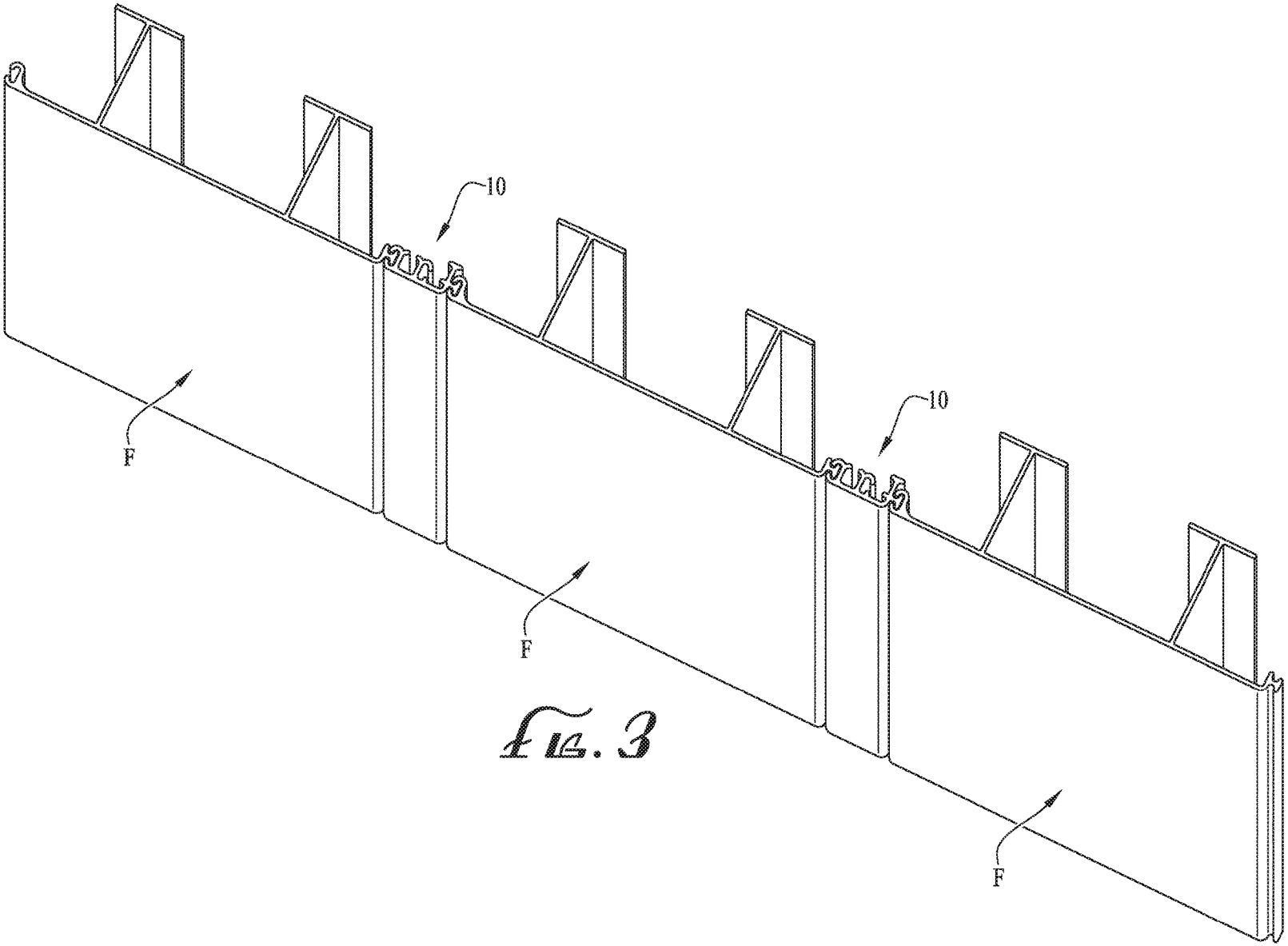
FIG. 3 shows two sheet piling filler-corner members according to FIG. 1 used in combination with flat panel sheet pilings to form a section of a barrier wall structure according to another example embodiment of the present invention.
Figure 4:
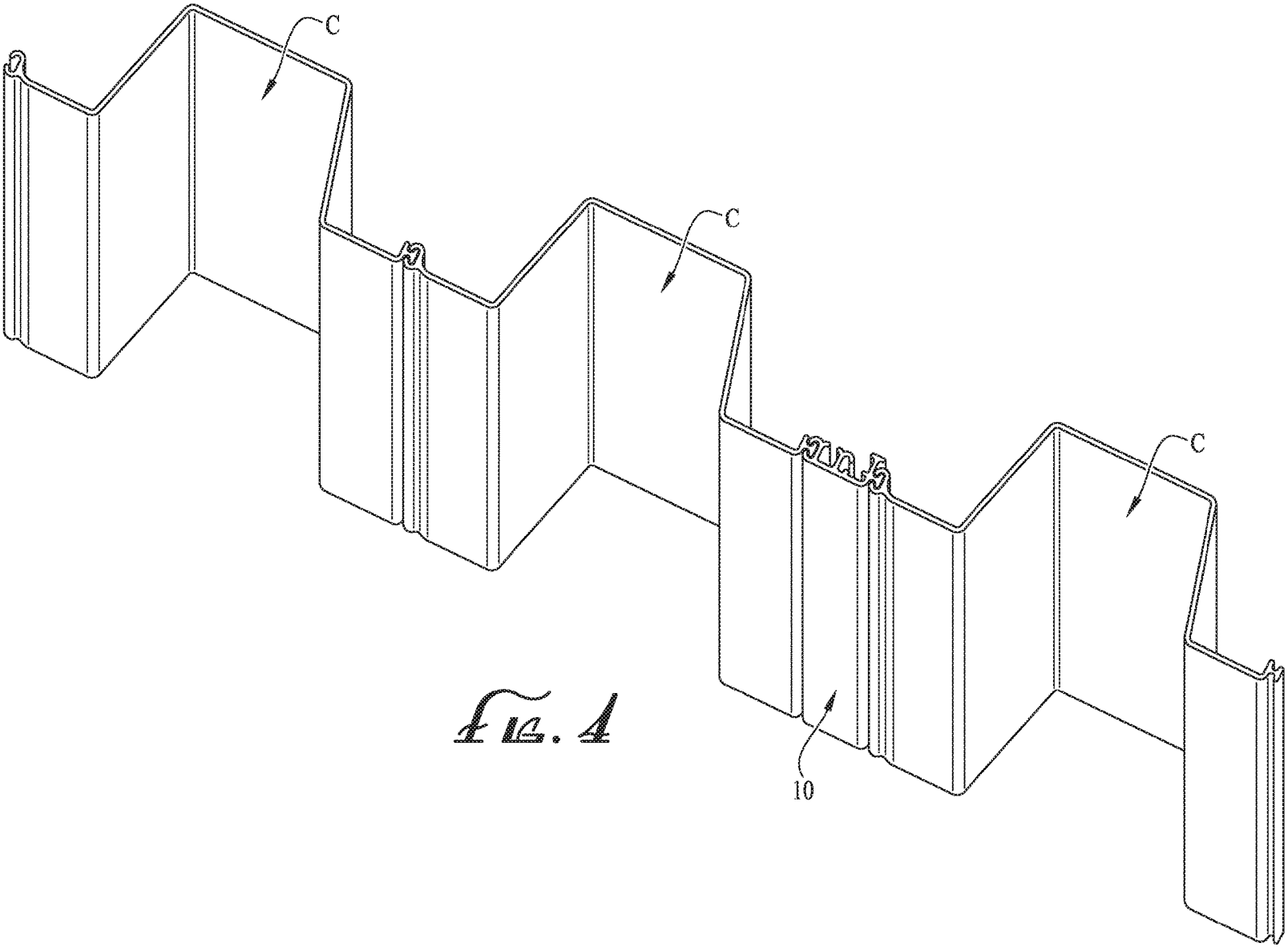
FIG. 4 shows a sheet piling filler-corner member according to FIG. 1 used in combination with C-channel or box format sheet pilings to form a section of a barrier wall structure according to another example embodiment of the present invention.

For example, FIG. 2 shows an unmodified sheet piling filler-corner member 10 used in combination with a plurality of flat panel sheet pilings F to form a section of a barrier wall structure according to an example embodiment of the present invention. The standard male lock member of a first flat panel sheet piling F is cooperatively engaged within the first female lock coupling 62 at the first side 12 of the filler-corner member 10, and the second male lock member 82 is cooperatively engaged within the standard female lock member of a second flat panel sheet piling F at the second side 14 of the filler-corner member, to form a generally straight or linear barrier wall or other sheet piling assembly or structure. In similar fashion, FIG. 3 shows two unmodified sheet piling filler-corner members 10 used in combination with a plurality of flat panel sheet pilings F to form a generally straight section of a barrier wall structure according to another example embodiment. The use or more or fewer sheet piling filler-corner members 10 in this manner allows the construction of sheet piling walls or other structures in various lengths, not limited to increments of full-width sheet piling dimensions, without the need for cutting and splicing, and maintaining the integrity of the lock couplings between elements of the assembly. FIG. 4 similarly shows an unmodified sheet piling filler-corner member 10 used in combination with a plurality of C-channel or box format sheet pilings C to form a section of a barrier wall structure according to another example embodiment. In alternate embodiments, two or more sheet piling filler-corner members may be used to fill gaps and extend the length of the sheet piling wall or other structure as needed.

Figure 5:
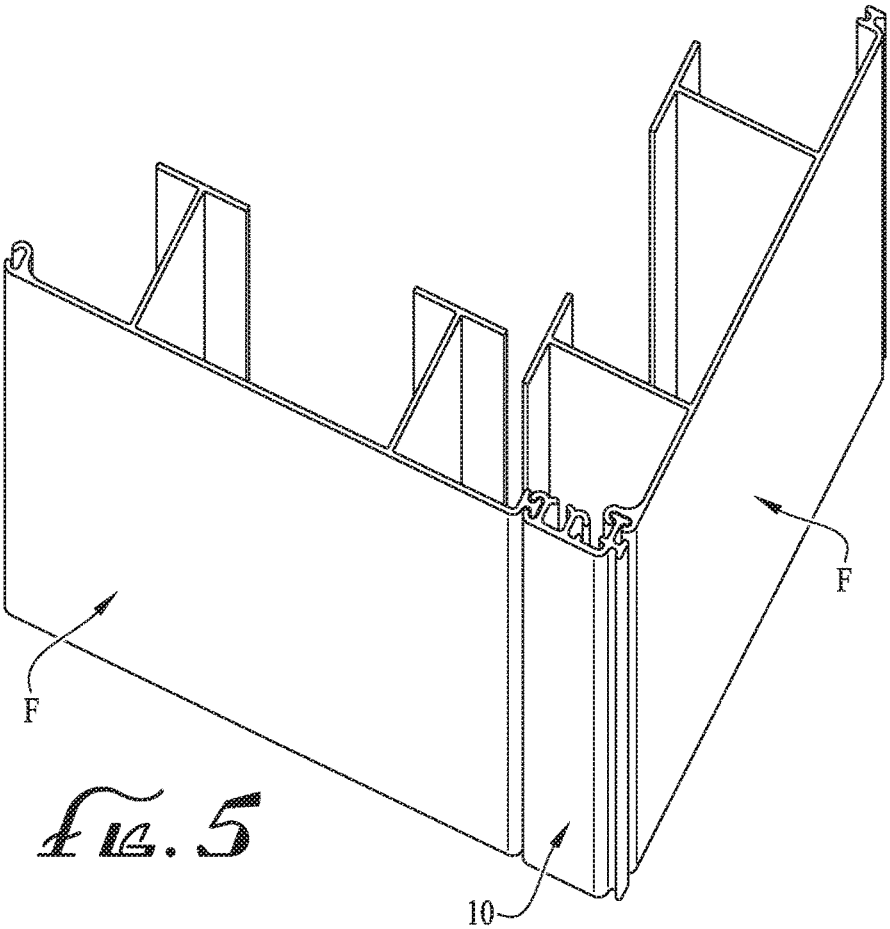
FIG. 5 shows a sheet piling filler-corner member according to FIG. 1 used in combination with flat panel sheet pilings to form a corner of a barrier wall structure according to another example embodiment of the present invention.
Figure 6:
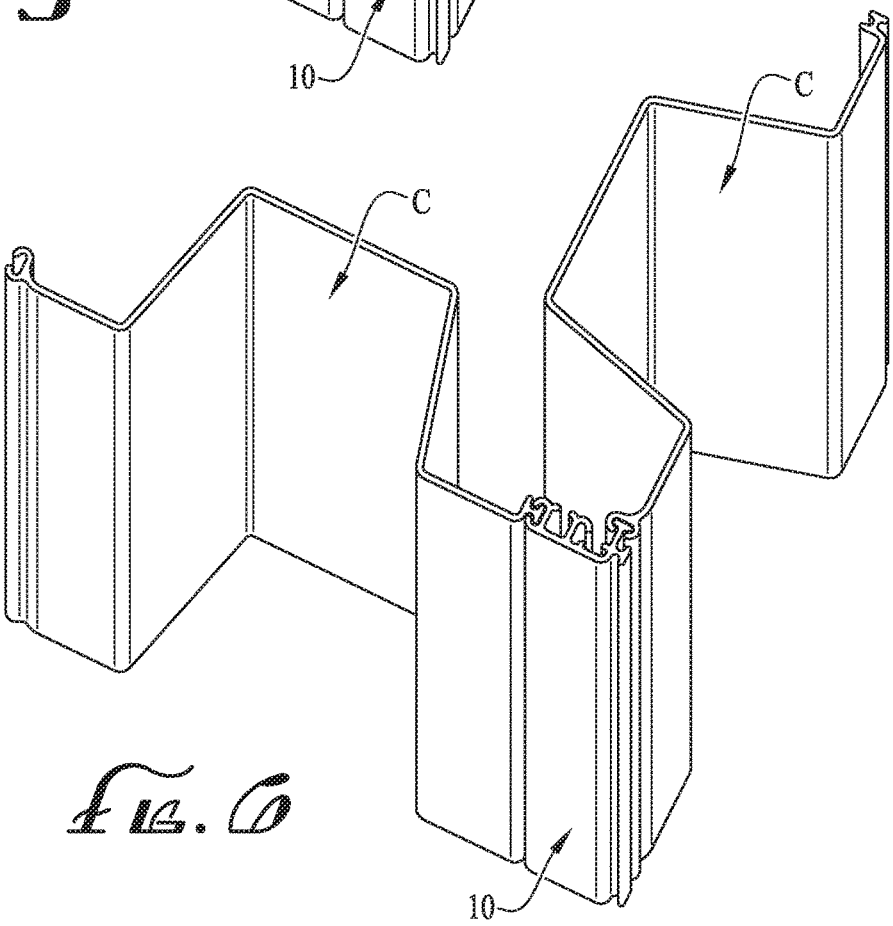
FIG. 6 shows a sheet piling filler-corner member according to FIG. 1 used in combination with C-channel or box format sheet pilings to form a corner of a barrier wall structure according to another example embodiment of the present invention.

FIG. 5 shows an unmodified sheet piling filler-corner member 10 used in combination with flat panel sheet pilings F to form a corner of a barrier wall structure according to another example embodiment of the present invention. The standard male lock member of a first flat panel sheet piling F is cooperatively engaged within the first female lock coupling 62 at the first side 12 of the filler-corner member 10, and the first male lock member 80 is cooperatively engaged within the standard female lock member of a second flat panel sheet piling F at the second side 14 of the filler-corner member, to form a corner, for example of about 90°, in a barrier wall or other sheet piling assembly or structure. FIG. 6 similarly shows an unmodified sheet piling filler-corner member 10 used in combination with a plurality of C-channel or box format sheet pilings C to form a corner section of a barrier wall structure according to another example embodiment.

Figure 7:
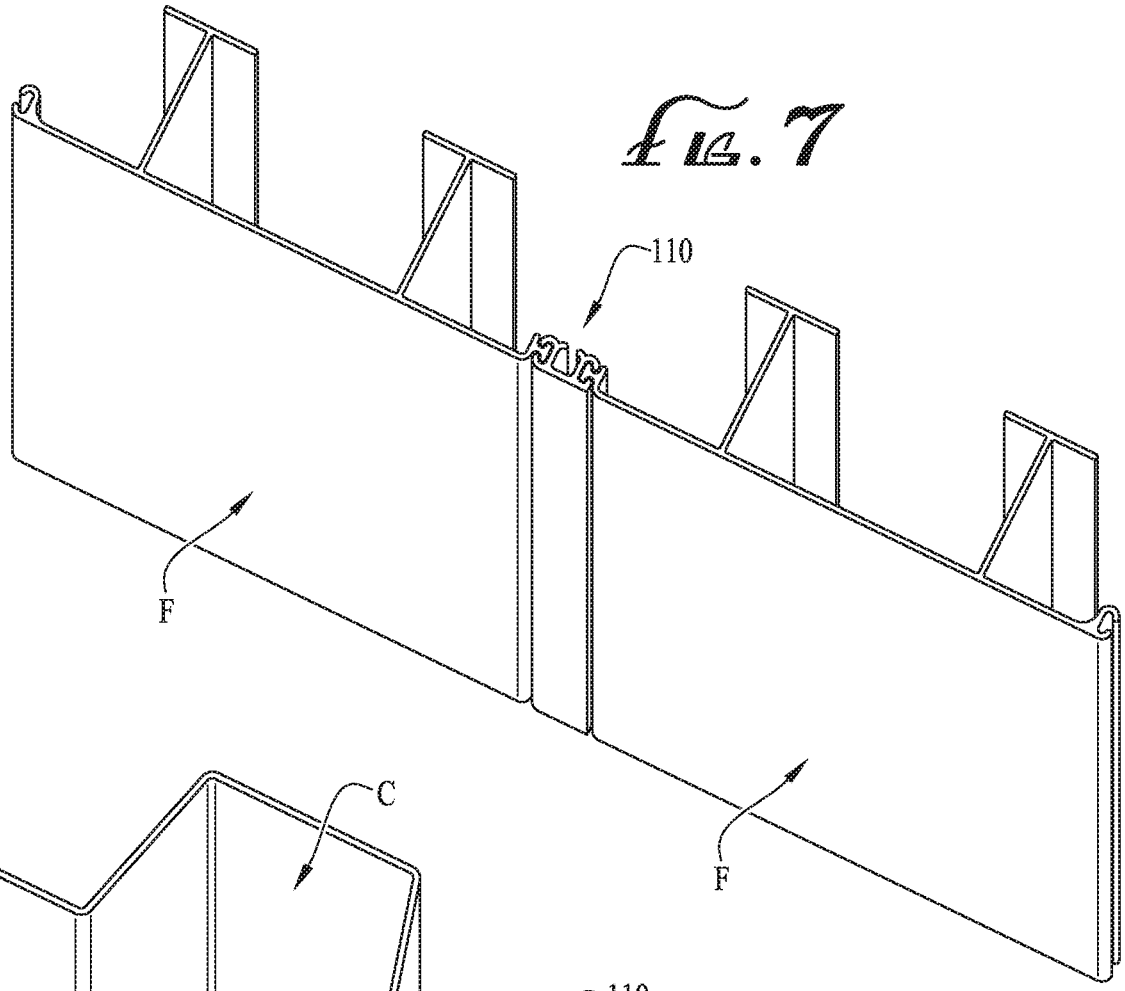
FIG. 7 shows a modified sheet piling filler-corner member used as a male-to-female gender changer adapter between male lock couplings of adjacent flat panel sheet pilings according to another example embodiment of the present invention.
Figure 8:
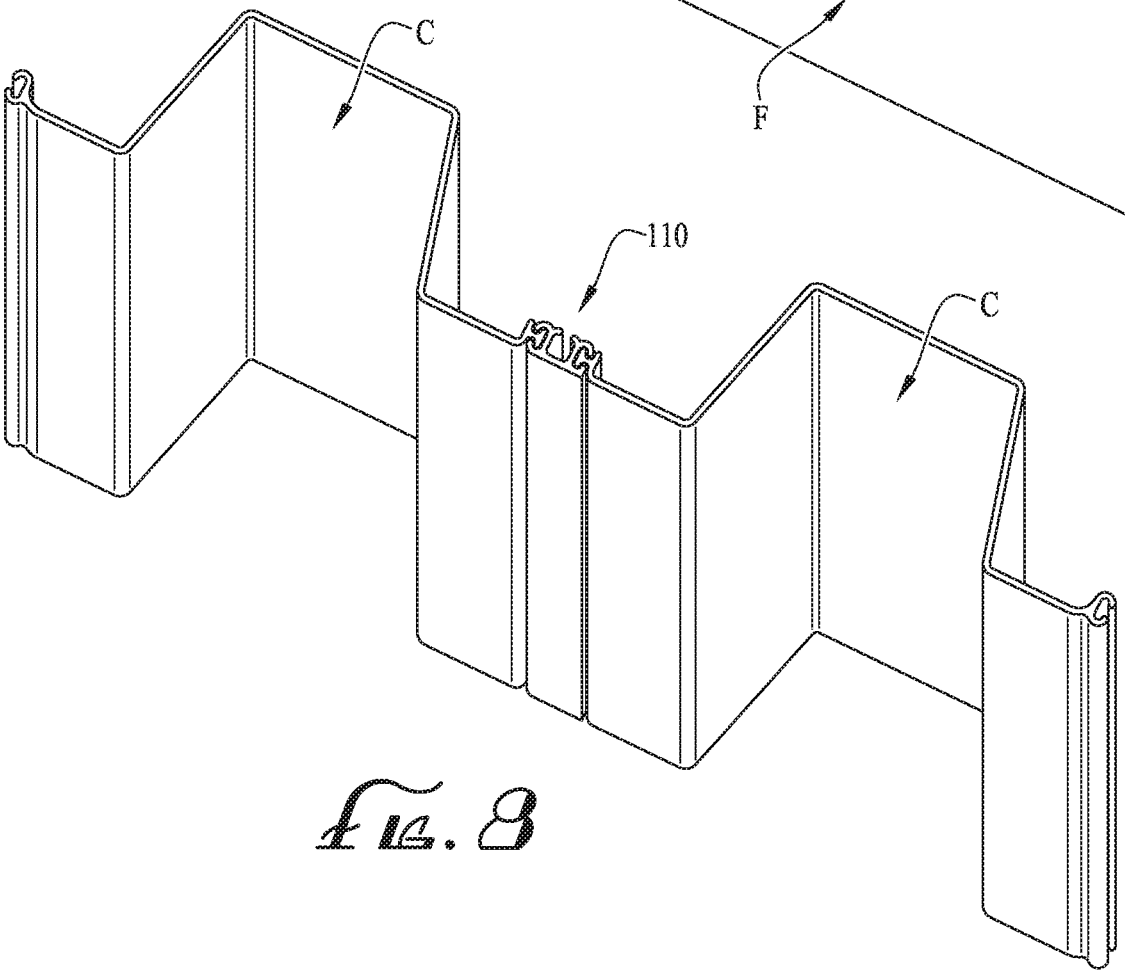
FIG. 8 shows a modified sheet piling filler-corner member used as a male-to-female gender changer adapter between male lock couplings of adjacent C-channel or box format sheet pilings according to another example embodiment of the present invention.

FIG. 7 shows one form of a modified sheet piling filler-corner member 110 used as a male-to-female gender changer adapter between confronting male lock couplings of adjacent flat panel sheet pilings F according to another example embodiment of the present invention. The modified sheet piling filler-corner member 110 has two opposed female lock couplings, formed by the first and third female lock couplings 62, 70 of the unmodified sheet piling filler-corner member 10, with the portion of the member beyond the transverse rib 46 to the second end 14 removed, as described in greater detail below with reference to FIG. 15 (i.e., FIGS. 15A-15D). In this manner, the standard male lock member of a first flat panel sheet piling F is cooperatively engaged within the first female lock coupling 62, and the third female lock coupling 70 is open at the opposite end for engagement with the standard male lock member of a second flat panel sheet piling F. As such, the 180° opposed and co-planarly aligned female-female couplings of the modified sheet piling filler-corner member 110 effectively change the gender of the male lock coupling of the first sheet piling F, providing an open female coupling for the male lock coupling of the second sheet piling, thereby enabling male-to-male sheet piling lock engagement. FIG. 8 similarly shows a modified sheet piling filler-corner member 110 used as a male-to-female gender changer adapter between male lock couplings of adjacent C-channel or box format sheet pilings C in a generally linear wall structure according to another example embodiment of the present invention.

Figure 9:
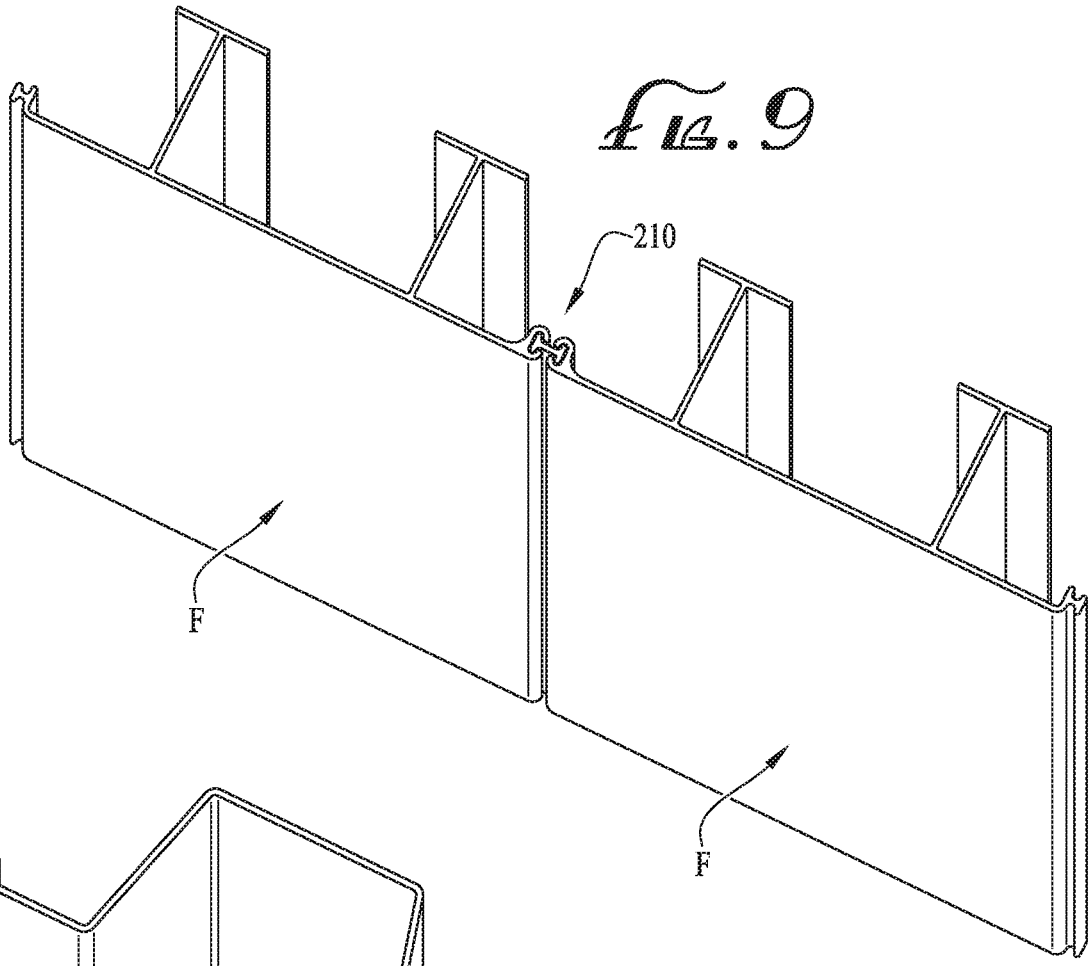
FIG. 9 shows a modified sheet piling filler-corner member used as a female-to-male gender changer adapter between female lock couplings of adjacent flat panel sheet pilings according to another example embodiment of the present invention.
Figure 10:
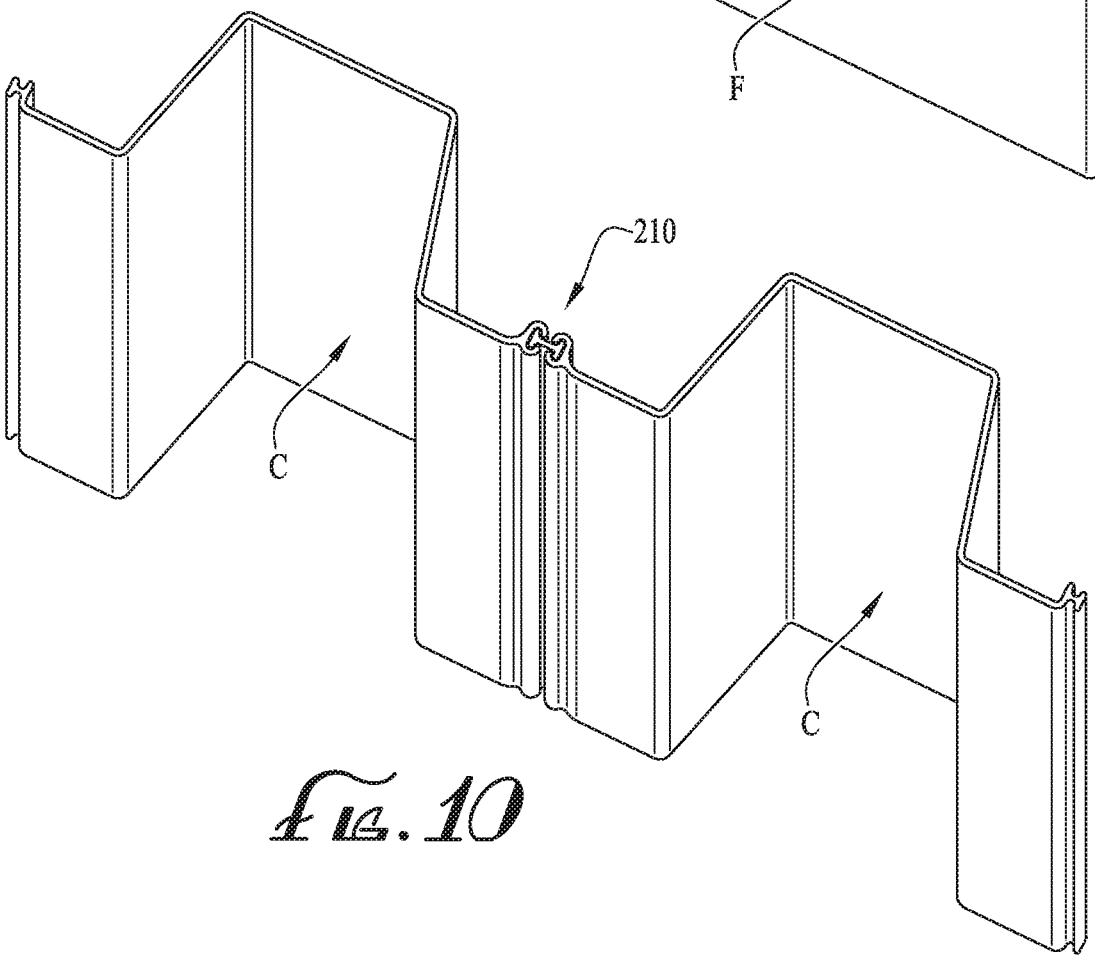
FIG. 10 shows a modified sheet piling filler-corner member used as a female-to-male gender changer adapter between female lock couplings of adjacent C-channel or box format sheet pilings according to another example embodiment of the present invention.

FIG. 9 shows another form of a modified sheet piling filler-corner member 210 used as a female-to-male gender changer adapter between female lock couplings of adjacent flat panel sheet pilings F according to another example embodiment of the present invention. The modified sheet piling filler-corner member 210 has two opposed male lock couplings, formed by the first male lock member 80 and another male lock member formed by the lateral rib 84 and the connecting web of the second male lock member 82, with the second male lock member and the portion of the member beyond the lateral rib removed as described in greater detail below with reference to FIG. 15. In this manner, the standard female lock member of a first flat panel sheet piling F is cooperatively engaged with the first male lock member 80, and the opposed male lock member formed by the lateral rib 84 and the connecting web of the second male lock member is exposed at the opposite end for engagement with the standard female lock member of a second flat panel sheet piling F. As such, the 180° opposed and co-planarly aligned male-male couplings of the modified sheet piling filler-corner member 210 effectively change the gender of the female lock coupling of the first sheet piling F, providing an exposed male coupling for engagement within the female lock coupling of the second sheet piling, thereby enabling female-to-female sheet piling lock engagement. FIG. 10 similarly shows a modified sheet piling filler-corner member 210 used as a female-to-male gender changer adapter between female lock couplings of adjacent C-channel or box format sheet pilings C in a generally linear wall structure according to another example embodiment of the present invention.

Figure 11:
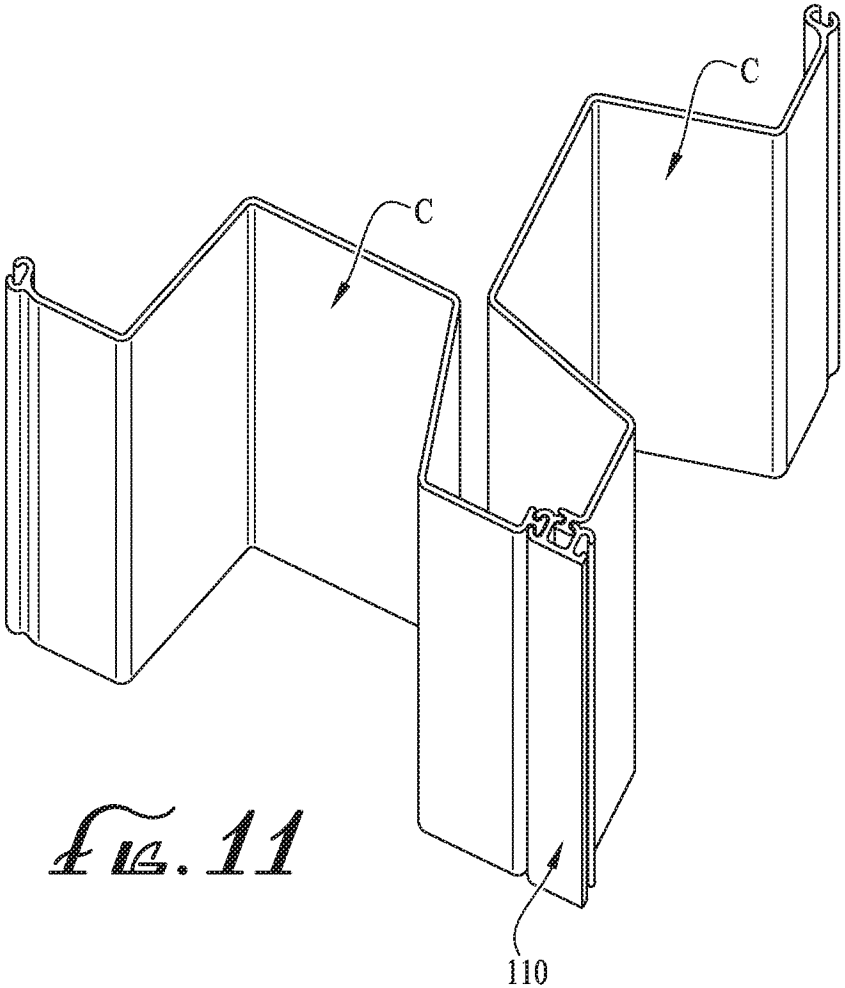
FIG. 11 shows a modified sheet piling filler-corner member used as a male-to-female gender changing corner coupling between male lock couplings of adjacent C-channel or box format sheet pilings according to another example embodiment of the present invention.

FIG. 11 shows a modified sheet piling filler-corner member 110 used as a male-to-female gender changing corner coupling between male lock couplings of adjacent C-channel or box format sheet pilings C at a corner section of a sheet piling wall according to another example embodiment of the present invention. The standard male lock member of a first sheet piling C is cooperatively engaged within the first female lock coupling 62, and the standard male lock member of a second sheet piling C is cooperatively engaged within the second female lock coupling 66, whereby the first and second sheet pilings are positioned generally perpendicular (i.e., 90°) to one another, thus forming a right angle corner of a sheet piling wall structure. The planarly transverse female-female couplings 62, 66 effectively change the gender of the male lock coupling of the first sheet piling C, providing a 90° offset female coupling for engagement with the male lock coupling of the second sheet piling, thereby enabling male-to-male corner coupling of sheet pilings.

Figure 12:
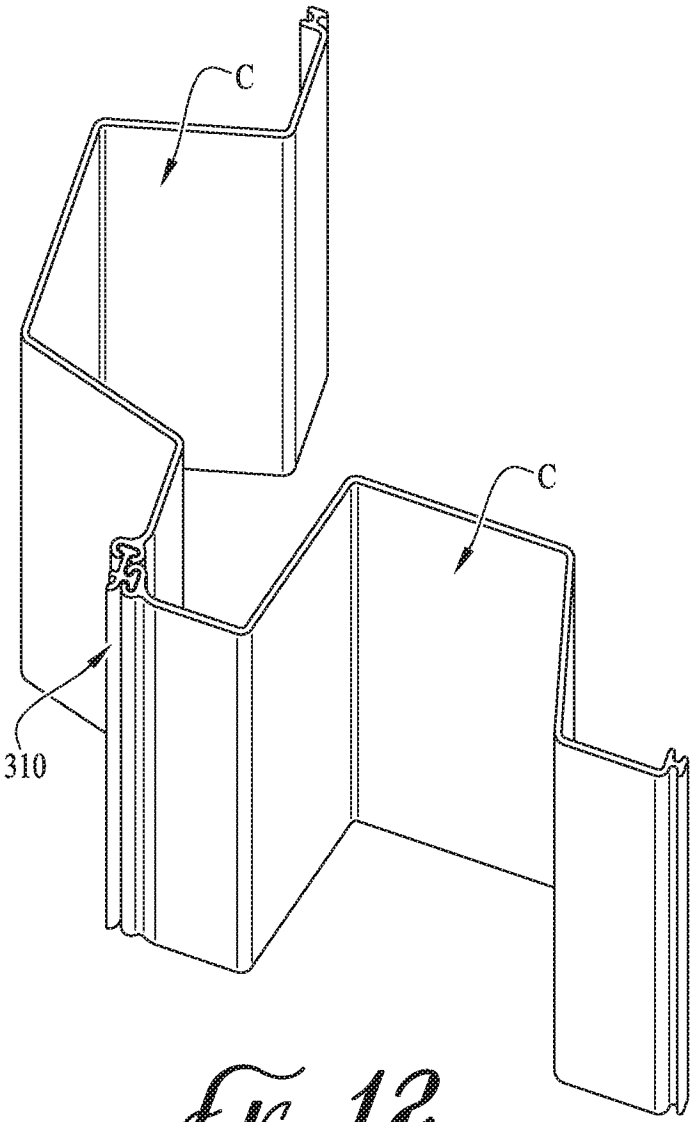
FIG. 12 shows a modified sheet piling filler-corner member used as a female-to-male gender changing corner coupling between female lock couplings of adjacent C-channel or box format sheet pilings according to another example embodiment of the present invention.

FIG. 12 shows another form of a modified sheet piling filler-corner member 310 used as a female-to-male gender changing corner coupling between female lock couplings of adjacent C-channel or box format sheet pilings C according to another example embodiment of the present invention. The modified sheet piling filler-corner member 310 has two planarly transverse male lock couplings, formed by the first male lock member 80 and the second male lock member 82, with the portion of the member from the second side flange 32 to the first side 12 removed as described in greater detail below with reference to FIG. 15. In this manner, the first male lock member 80 is cooperatively engaged with standard female lock coupling of the first sheet piling C, thereby providing an exposed second male lock member 82 for cooperative engagement with the standard female lock coupling of the second sheet piling C, to form a 90° corner between the sheet pilings.

Figure 13B:
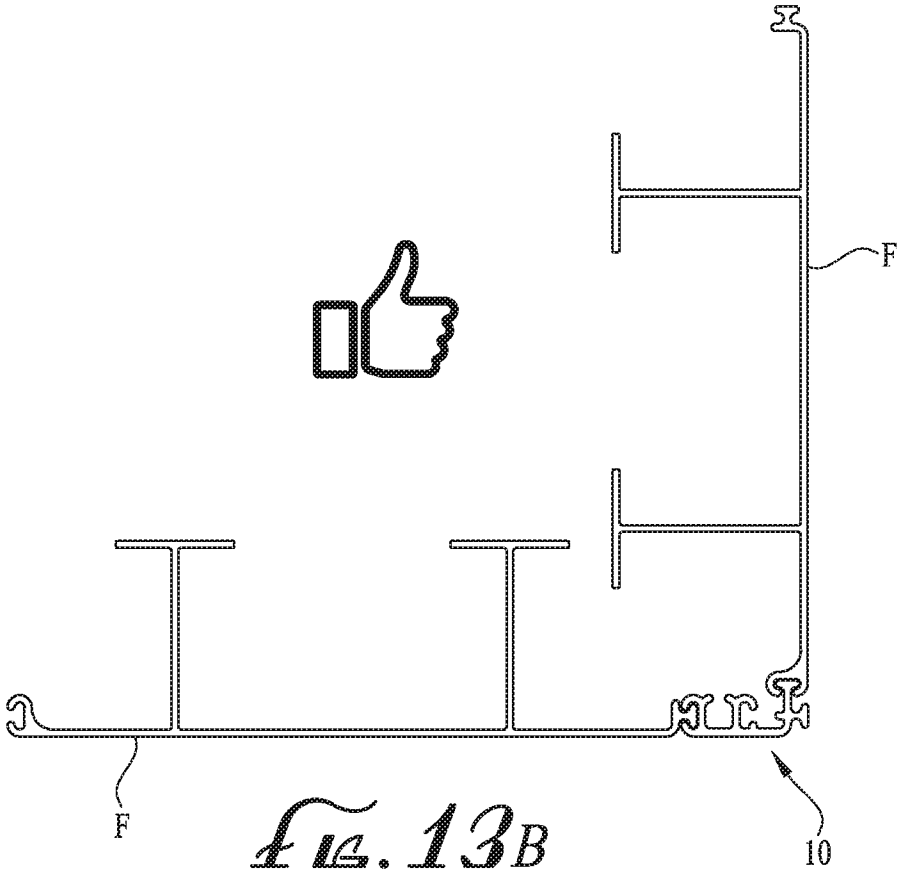
FIG. 13B shows a sheet piling filler-corner member according to FIG. 1 used in combination with flat panel sheet pilings to form a corner of a barrier wall structure, and providing sufficient clearance to avoid interference between leg flanges, according to another example embodiment of the present invention.
Figure 13A:
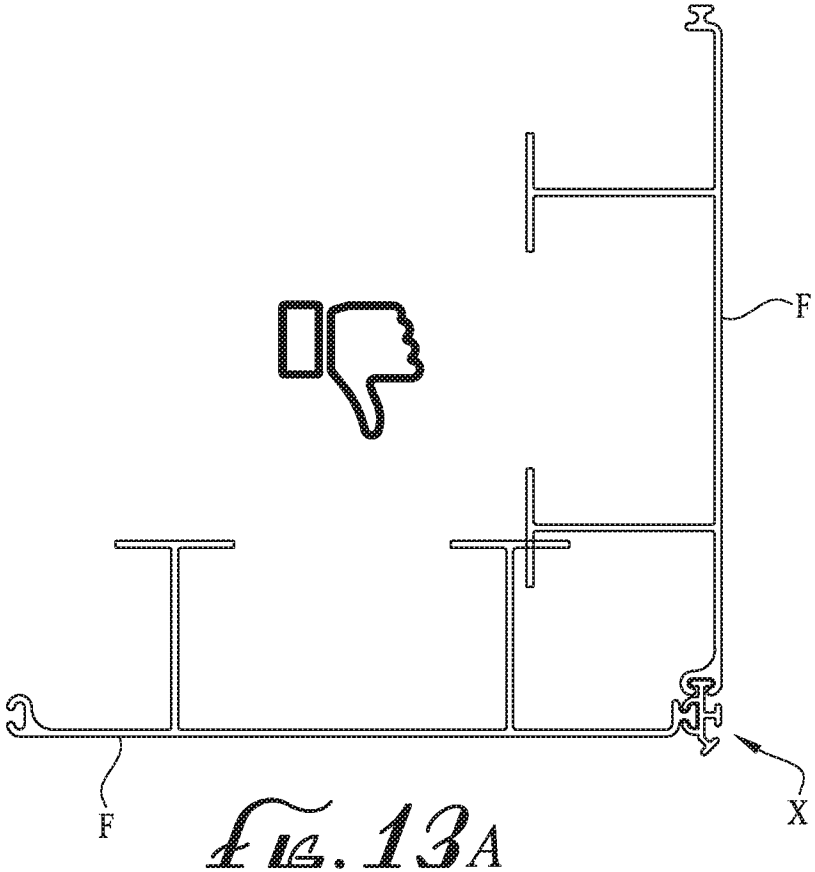
FIG. 13A shows a previously known corner coupling resulting in interference between leg flanges of adjacent flat panel sheet pilings.

FIGS. 13A and 13B demonstrate a particular problem addressed by the sheet piling filler-corner member 10 according to example embodiments and applications of the invention. When constructing an inside corner using a previously known corner coupling X, the leg flanges of flat panel sheet pilings F adjacent the corner may interfere with one another as shown in FIG. 13A. This undesirably necessitates cutting the flanges or otherwise altering the components, which may adversely affect the structural strength of the assembly and require additional time and expense for construction. FIG. 13B, by contrast, shows the sheet piling filler-corner member 10 according an example embodiment of the present invention used in combination with flat panel sheet pilings F to form an inside corner of a barrier wall structure, and providing sufficient clearance to avoid interference the adjacent between leg flanges, thereby avoiding the need for alteration of the components.

Figure 14A:
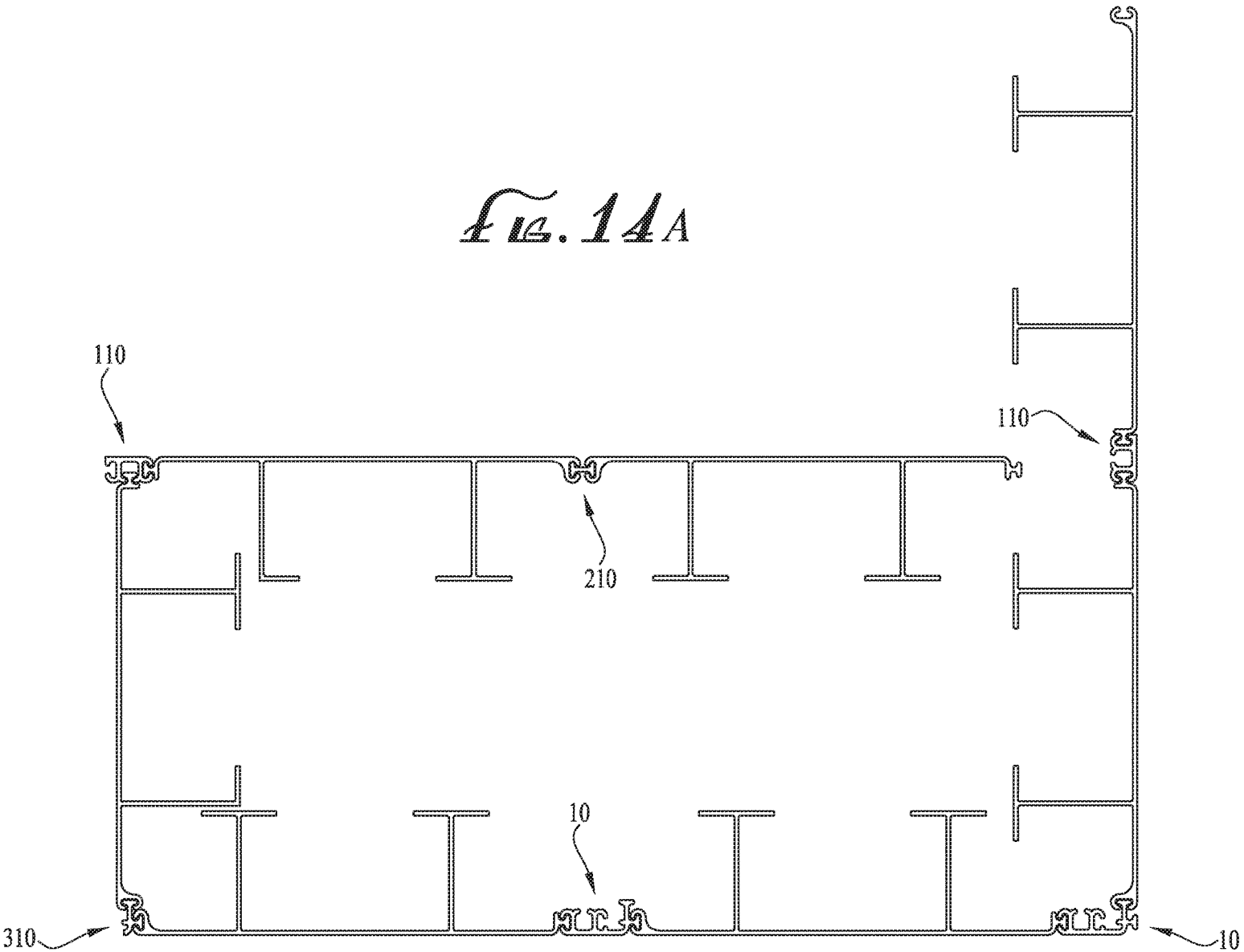
FIG. 14A shows an assembly of multiple flat panel sheet pilings with modified and unmodified sheet piling filler-corner members joining the sheet pilings in various manners, according to example embodiments of the present invention.
Figure 14B:
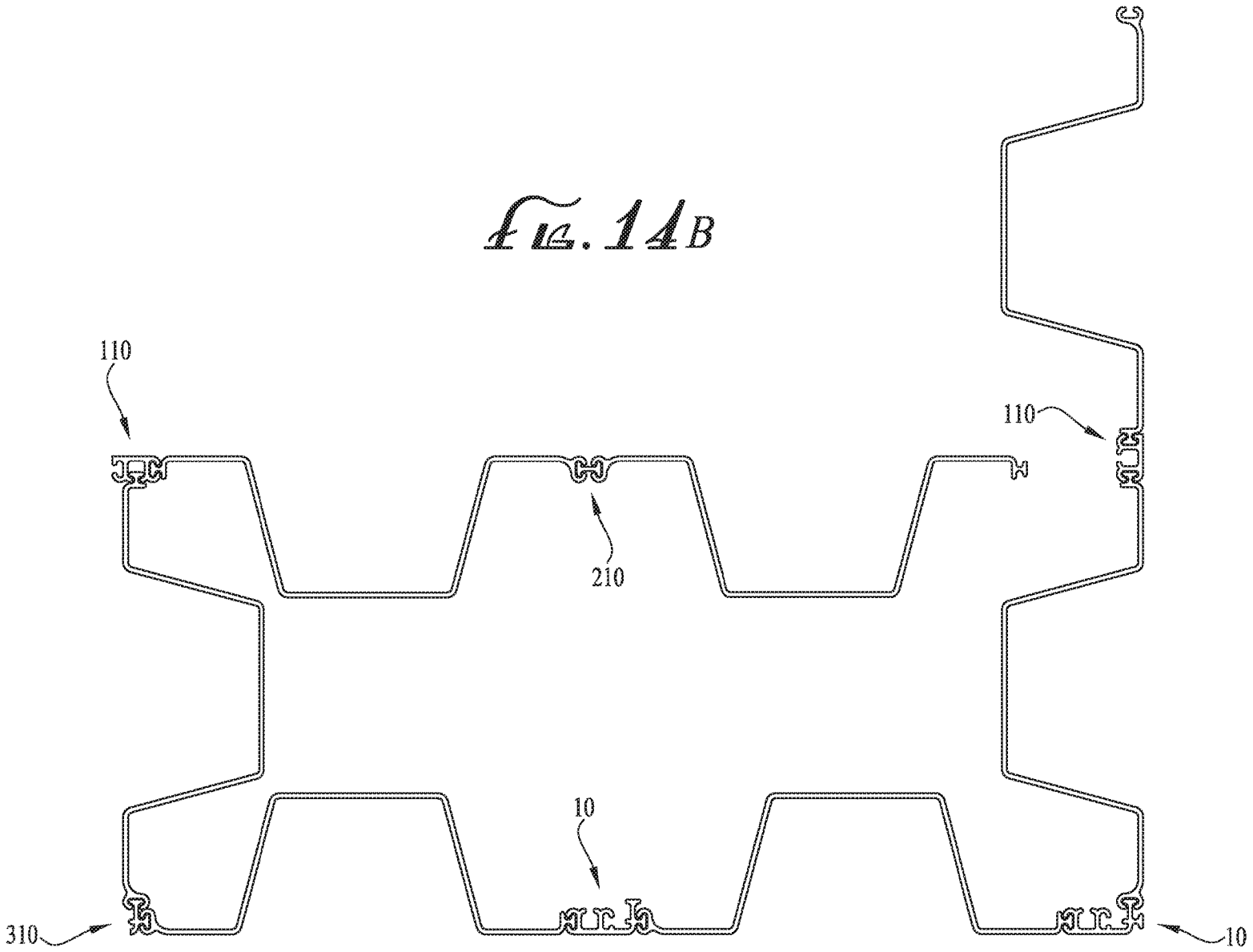
FIG. 14B shows an assembly of multiple C-channel or box format sheet pilings with modified and unmodified sheet piling filler-corner members joining the sheet pilings in various manners, according to example embodiments of the present invention.
Figure 15A:
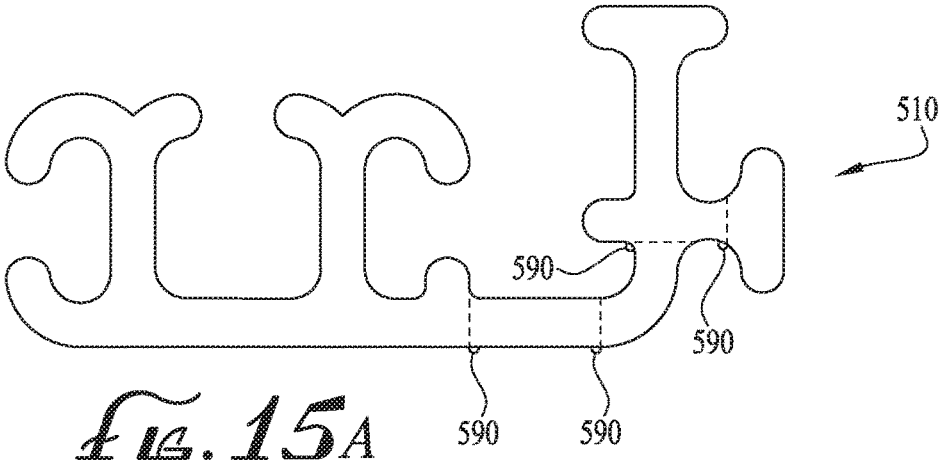
FIGS. 15A, 15B, 15C and 15D show cut lines for modification of the sheet piling filler-corner member, and modified members formed by cutting the filler-corner member at the cut lines, according to example embodiments of the present invention.
Figure 15B:
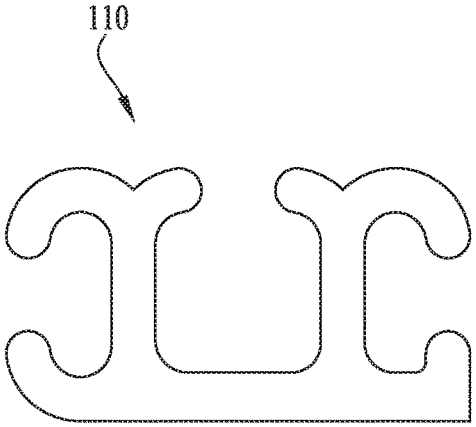
Figure 15C:
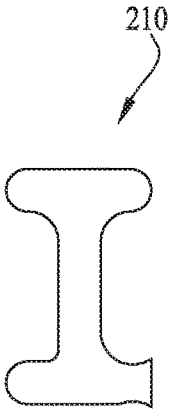
Figure 15D:
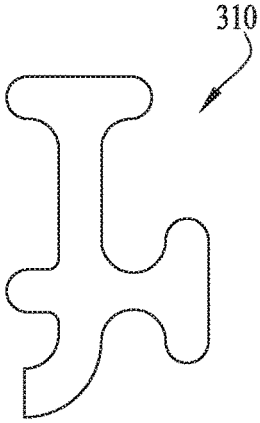

FIG. 14A shows an assembly of multiple flat panel sheet pilings F with modified and unmodified sheet piling filler-corner members 10, 110, 210 and 310 joining the sheet pilings in various manners, according to example embodiments of the present invention. FIG. 14B similarly shows an assembly of multiple C-channel or box format sheet pilings C with modified and unmodified sheet piling filler-corner members 10, 110, 210 and 310 joining the sheet pilings in various manners, according to further example embodiments of the present invention. As will be recognized by those of skill in the art in view of the present disclosure, various other sheet piling assembly configurations may be formed using modified and unmodified sheet piling filler-corner members according to example embodiments in combination with these and other sheet piling formats.

FIGS. 15A, 15B, 15C and 15D show cut lines (indicated in broken or dashed lines) for use in connection with methods of modification of a sheet piling filler-corner member 510 and resulting modified members 110, 210 and 310 which may be formed by cutting the filler-corner member at the cut lines, according to example embodiments of the present invention. The sheet piling filler-corner member 510 optionally includes one or more field cutting guide marks 590, such as small ribs or recesses extending along the length of the member, printed markings, or other indicators, to indicate cut line locations used to form the modified members 110, 210 and 310. Installation personnel may cut the sheet piling filler-corner member 510 using a circular saw or other cutting tool to form the desired configuration of modified members 110, 210 and 310. In this manner, the sheet piling filler-corner member 510 provides a universal component that may be adapted for the various uses and applications disclosed herein.

Figure 16:
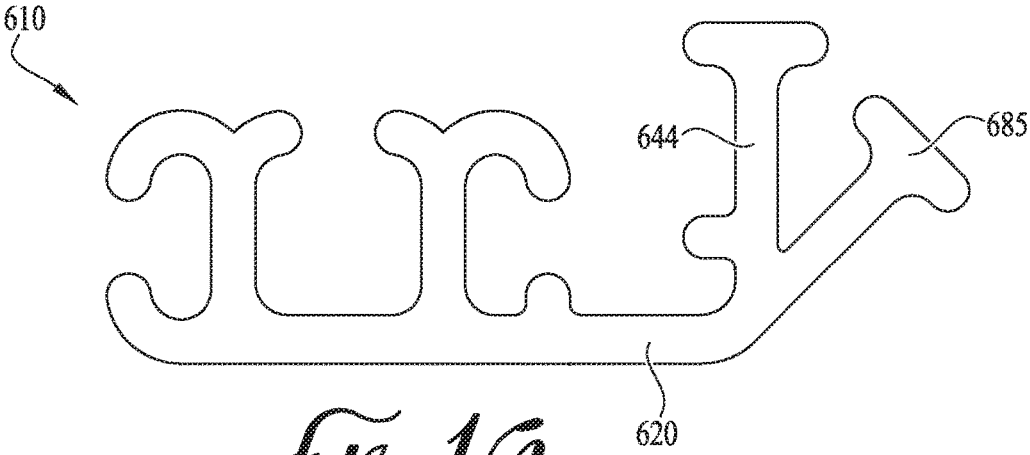
FIG. 16 shows a sheet piling filler-corner member according to another example embodiment of the present invention.

FIG. 16 shows a sheet piling filler-corner member 610 according to another example embodiment of the present invention. This embodiment is substantially similar to the above described embodiments but includes an obliquely angled offset of the second male lock member 685, relative to the main body panel 620 and the third transverse flange 644. The offset angle may be 45°, 30°, or other angles of offset.

While the invention has been described with reference to example embodiments, it will be understood by those skilled in the art that a variety of modifications, additions and deletions are within the scope of the invention, as defined by the following claims.

What is claimed is:

1. A sheet piling filler-corner member comprising:

a main body panel having a first side and a second side, and defining a width-wise dimension extending between the first and second sides;

a first female lock coupling at the first side of the main body panel configured to receive a male sheet piling coupling member, and a male lock member at the second side of the main body panel configured for engagement within a female sheet piling coupling; and a second female lock coupling;

wherein the male lock member is aligned opposite the first female lock coupling in a first plane extending in the width-wise dimension, and wherein the second female lock coupling comprises a slot defining a coupling axis offset generally perpendicular to the first plane.

2. The sheet piling filler-corner member of claim 1, further comprising a third female lock coupling angularly offset 180° from the first female lock coupling.

3. The sheet piling filler-corner member of claim 1, further comprising an offset male lock member angularly offset from the first plane.

4. The sheet piling filler-corner member of claim 1, further comprising a lateral rib extending in the width-wise dimension generally opposite from the male lock member.

5. The sheet piling filler-corner member of claim 1, comprising a majority content of recycled material and a minority content of virgin material.

6. The sheet piling filler-corner member of claim 1, configured for use in connection with sheet pilings having a sheet piling width, and wherein the sheet piling filler-corner member defines a filler width in the width-wise dimension that is an even divisor of the sheet piling width.

7. The sheet piling filler-corner member of claim 1, further comprising at least one field cutting guide mark, indicating a cut location for forming one or more modified sheet piling filler-corner member configurations.

8. A sheet piling filler-corner member comprising:

a main body panel;

a first female lock coupling configured to receive a male sheet piling coupling member of a first sheet piling along a first female coupling axis;

a first male lock coupling and a second male lock coupling, each of the first and second male lock couplings being configured for engagement within a female sheet piling coupling of a second sheet piling, wherein the second male lock coupling defines a second male coupling axis that is planarly aligned with the first female coupling axis in a first plane for use in a filler configuration, and wherein the first male lock coupling defines a first male coupling axis aligned in a second plane that is angularly offset from the first plane for use in a first corner configuration; and a second female lock coupling configured to receive a male sheet piling coupling member of a third sheet piling along a second female coupling axis aligned in a third plane that is angularly offset from the first plane.

9. The sheet piling filler-corner member of claim 8, wherein the third plane is angularly offset from the first plane by about 90°.

10. The sheet piling filler-corner member of claim 8, further comprising a third female lock coupling.

11. The sheet piling filler-corner member of claim 8, further comprising a lateral rib extending generally opposite from the second male lock member.

12. The sheet piling filler-corner member of claim 8, comprising a majority content of recycled material and a minority content of virgin material.

13. The sheet piling filler-corner member of claim 8, wherein the first and second sheet pilings define a standard sheet piling width, and wherein the sheet piling filler-corner member defines a filler width that is an even divisor of the standard sheet piling width.

14. The sheet piling filler-corner member of claim 8, further comprising at least one field cutting guide mark, indicating a cut location for forming one or more modified sheet piling filler-corner member configurations.

15. A sheet piling filler-corner member comprising:

first and second female lock couplings, each of the first and second female lock couplings being configured to receive a male sheet piling coupling member, the first female lock coupling comprising a first slot defining a first female coupling axis and the second female lock coupling comprising a second slot defining a second female coupling axis; and first and second male lock couplings, the first male lock coupling being configured for engagement within a female sheet piling coupling along a first male coupling axis, and the second male lock coupling being configured for engagement within a female sheet piling coupling along a second male coupling axis;

wherein the first female coupling axis is aligned with the second male coupling axis in a first plane, and wherein the second female coupling axis is aligned in a second plane that is angularly offset from the first plane; and wherein the sheet piling filler-corner member is configured for use in a filler configuration between first and second sheet pilings aligned in a generally linear assembly, and alternatively for use in a corner configuration between first and second sheet pilings aligned in an angularly offset assembly.

16. The sheet piling filler-corner member of claim 15, wherein the sheet piling filler-corner member is further configured for use in a gender-change adapter configuration wherein the first and second sheet piling are arranged in male-male or female-female coupling orientations.

17. The sheet piling filler-corner member of claim 15, wherein the sheet piling filler-corner member is further configured for modification by removal of one or more segments to form a plurality of modified sheet piling filler-corner members.

18. A sheet piling filler-corner member comprising:

at least two female lock couplings, each of the female lock couplings being configured to receive a male sheet piling coupling member;

at least two male lock couplings, each of the male lock couplings being configured for engagement within a female sheet piling coupling; and at least one field cutting guide mark configured to indicate a cut line for modifying the sheet piling filler-corner member to form at least one modified member;

wherein one of the female lock couplings and one of the male lock couplings are aligned along a first plane, and wherein another of the female lock couplings is oriented generally perpendicular to the first plane; and wherein the sheet piling filler-corner member is configured for use in a filler configuration between first and second sheet pilings aligned in a generally linear assembly aligned with the first plane, and for use in a corner configuration between first and second sheet pilings aligned in an assembly angularly offset from the first plane.

19. A sheet piling filler-corner member comprising:

at least two female lock couplings, each of the female lock couplings being configured to receive a male sheet piling coupling member; and at least two male lock couplings, each of the male lock couplings being configured for engagement within a female sheet piling coupling;

wherein one of the female lock couplings and one of the male lock couplings are aligned along a first plane, and wherein another of the female lock couplings is oriented generally perpendicular to the first plane; and wherein the sheet piling filler-corner member is configured for use in a filler configuration between first and second sheet pilings aligned in a generally linear assembly aligned with the first plane, and for use in a corner configuration between first and second sheet pilings aligned in an assembly angularly offset from the first plane; and wherein the sheet piling filler-corner member comprises a base portion of recycled material and a cladding of virgin material.

20. A sheet piling filler-corner member comprising:

at least three female lock couplings, each of the three female lock couplings being configured to receive a male sheet piling coupling member; and at least two male lock couplings, each of the male lock couplings being configured for engagement within a female sheet piling coupling;

wherein one of the female lock couplings and one of the male lock couplings are aligned along a first plane, and wherein another of the female lock couplings is oriented generally perpendicular to the first plane; and wherein the sheet piling filler-corner member is configured for use in a filler configuration between first and second sheet pilings aligned in a generally linear assembly aligned with the first plane, and for use in a corner configuration between first and second sheet pilings aligned in an assembly angularly offset from the first plane.

21. A sheet piling filler-corner member comprising:

at least two female lock couplings, each of the female lock couplings being configured to receive a male sheet piling coupling member; and at least two male lock couplings, each of the male lock couplings being configured for engagement within a female sheet piling coupling;

wherein one of the female lock couplings and one of the male lock couplings are aligned along a first plane, and wherein another of the female lock couplings is oriented generally perpendicular to the first plane; and wherein the sheet piling filler-corner member is configured for use in a filler configuration between first and second sheet pilings aligned in a generally linear assembly aligned with the first plane, and for use in a corner configuration between first and second sheet pilings aligned in an assembly angularly offset from the first plane;

and wherein the sheet piling filler-corner member comprises segments configured to be cut to form a plurality of modified members including:

(i) a first fill piece modified member comprising two 180° opposed female lock couplings;

(ii) a second fill piece modified member comprising two 180° opposed male lock couplings; and (iii) a corner piece modified member comprising two 90° offset lock couplings.

* * * * *